US009389545B2

(12) United States Patent
Kondo

(10) Patent No.: US 9,389,545 B2
(45) Date of Patent: Jul. 12, 2016

(54) IMAGE FORMING APPARATUS, IMAGE FORMING METHOD

(71) Applicant: KYOCERA Document Solutions Inc., Osaka-shi, Osaka (JP)

(72) Inventor: Ayaka Kondo, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/724,720

(22) Filed: May 28, 2015

(65) Prior Publication Data

US 2015/0346649 A1 Dec. 3, 2015

(30) Foreign Application Priority Data

May 30, 2014 (JP) ..... 2014-113503

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0189* (2013.01); *G03G 15/0136* (2013.01)

(58) Field of Classification Search
CPC ..... G03G 15/14; G03G 15/1605; G03G 15/1615; G03G 21/168
See application file for complete search history.

(56) References Cited

U.S. PATENT DOCUMENTS 8,417,165 B2 * 4/2013 Kasuya ..... G03G 15/161 399/299
2008/0199197 A1 * 8/2008 Suzuki ..... G03G 15/2025 399/67
2010/0303488 A1 * 12/2010 Yanagi ..... G03G 15/065 399/45
2011/0286773 A1 * 11/2011 Hagari ..... G03G 15/161 399/302
2013/0322934 A1 * 12/2013 Hatano ..... G03G 15/1615 399/302

FOREIGN PATENT DOCUMENTS

JP 2005010389 A 1/2005

* cited by examiner

*Primary Examiner* — Walter L Lindsay, Jr.
*Assistant Examiner* — Jessica L Eley
(74) *Attorney, Agent, or Firm* — Alleman Hall McCoy Russell & Tuttle LLP

(57) ABSTRACT

An image forming apparatus includes a plurality of image carriers, an intermediate transfer belt, a plurality of transfer rollers, a print control portion, and a contact pressure control portion. The plurality of transfer rollers are provided in such a way as to be in contact with the intermediate transfer belt at positions respectively corresponding to the image carriers. The print control portion executes a print process in a first print mode or a second print mode that are set in advance. The contact pressure control portion, when the print process is executed in the first print mode, reduces a contact pressure of one or more transfer rollers that are, among the plurality of transfer rollers, disposed on a downstream side in a conveyance direction of the intermediate transfer belt, to be lower than a contact pressure in the second print mode.

7 Claims, 5 Drawing Sheets

IMAGE FORMING APPARATUS, IMAGE FORMING METHOD

INCORPORATION BY REFERENCE

This application is based upon and claims the benefit of priority from the corresponding Japanese Patent Application No. 2014-113503 filed on May 30, 2014, the entire contents of which are incorporated herein by reference.

BACKGROUND

The present disclosure relates to an image forming apparatus and an image forming method for forming a color image.

There is generally known an image forming apparatus such as a printer that can form a color image by the electrophotography. In this type of image forming apparatus, a color image is formed, for example, through a procedure in which a plurality of toner images of different colors formed on image carriers such as photoconductor drums are transferred in such a way as to be overlaid in sequence on the intermediate transfer belt, and then the toner images of different colors overlaid on the intermediate transfer belt are transferred on a transfer target member such as a sheet.

Meanwhile, in this type of image forming apparatus, when a character image is printed, a phenomenon called void of image may occur, in which a part of the toner images formed on the image carriers is not transferred to the intermediate transfer belt, and a hole is made in the toner image on the intermediate transfer belt. It is known that the void of image occurs when the toner aggregates in transfer nip portions due to stress concentration, wherein the transfer nip portions are formed by the image carriers, the intermediate transfer belt, and transfer rollers for transferring the toner images to the intermediate transfer belt. As a technology related to this problem, there is known an image forming apparatus that can restrict the occurrence of the void of image by reducing the contact pressure applied to the intermediate transfer belt, wherein the contact pressure to be reduced may be the contact pressure applied to the intermediate transfer belt from all the transfer rollers or the contact pressure applied only from a transfer roller for transferring a black toner image.

SUMMARY

An image forming apparatus according to an aspect of the present disclosure includes a plurality of image carriers, an intermediate transfer belt, a plurality of transfer rollers, a print control portion, and a contact pressure control portion. The plurality of image carriers carry toner images of different colors. The intermediate transfer belt is provided in such a way as to be in contact with the image carriers and on which the toner images carried by the image carriers are transferred and overlaid. The plurality of transfer rollers are provided in such a way as to be in contact with the intermediate transfer belt at positions respectively corresponding to the image carriers, and configured to transfer the toner images carried by the image carriers to the intermediate transfer belt. The print control portion executes a print process in a first print mode or a second print mode that are set in advance. The contact pressure control portion, when the print process is executed in the first print mode, reduces a contact pressure of one or more transfer rollers that are, among the plurality of transfer rollers, disposed on a downstream side in a conveyance direction of the intermediate transfer belt, to be lower than a contact pressure thereof in the second print mode.

An image forming method according to another aspect of the present disclosure is an image forming method executed in an image forming apparatus including a plurality of image carriers configured to carry toner images of different colors, an intermediate transfer belt provided in such a way as to be in contact with the image carriers and on which the toner images carried by the image carriers are transferred and overlaid, and a plurality of transfer rollers provided in such a way as to be in contact with the intermediate transfer belt at positions respectively corresponding to the image carriers, and configured to transfer the toner images carried by the image carriers to the intermediate transfer belt. The image forming method includes a first step and a second step. In the first step, a print process is executed in a first print mode or a second print mode that are set in advance. In the second step, when the print process is executed in the first print mode, a contact pressure of one or more transfer rollers that are, among the plurality of transfer rollers, disposed on a downstream side in a conveyance direction of the intermediate transfer belt, is reduced to be lower than a contact pressure thereof in the second print mode.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the disclosure. It should be noted that the following description is an example of a specific embodiment of the present disclosure and should not limit the technical scope of the disclosure.

[Outlined Configuration of Image Forming Apparatus 10]

Figure 1:
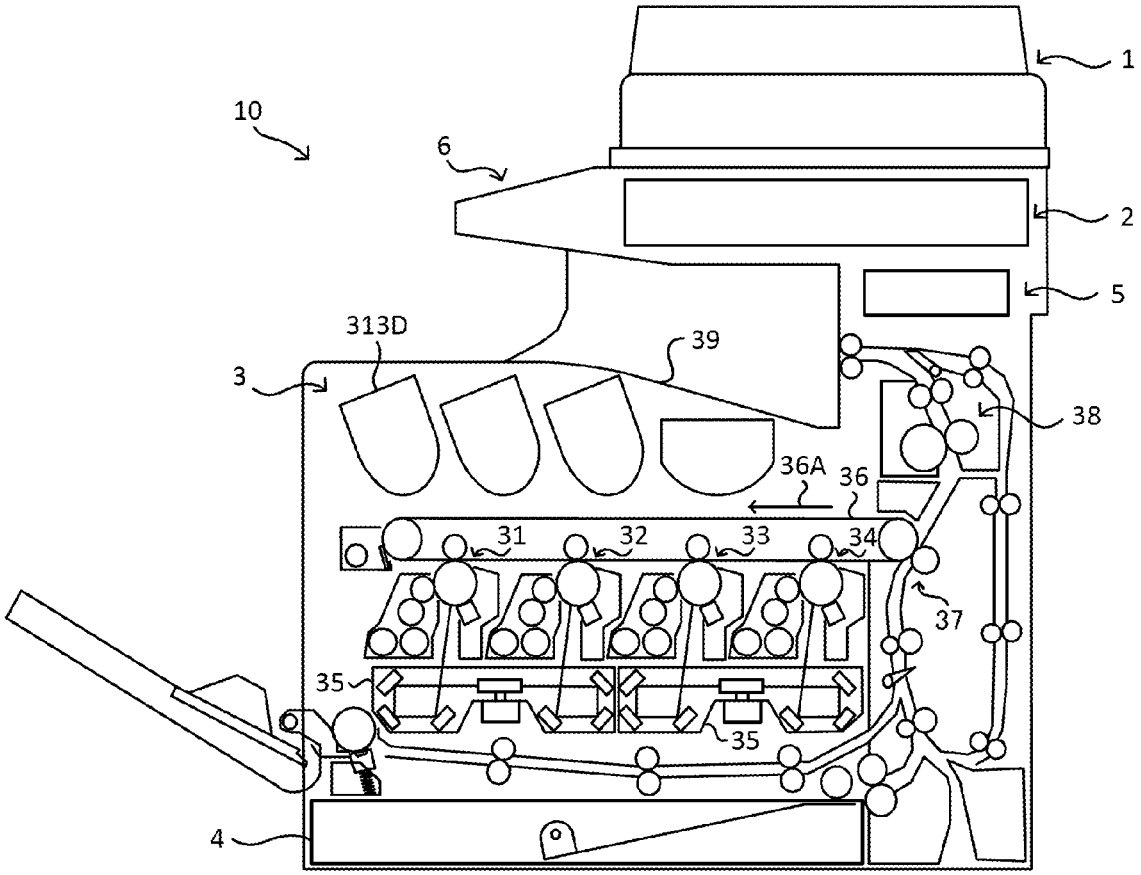
FIG. 1 is a diagram showing the configuration of an image forming apparatus according to an embodiment of the present disclosure.
Figure 3:
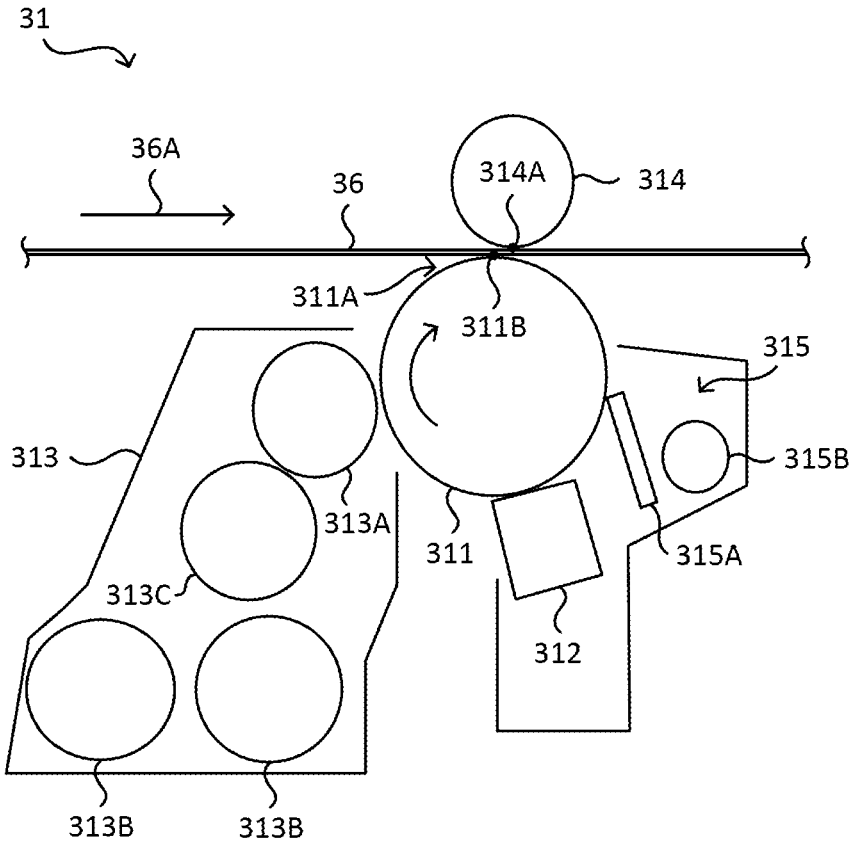
FIG. 3 is a diagram showing the configuration of an image forming unit included in the image forming apparatus according to an embodiment of the present disclosure.
Figure 4:
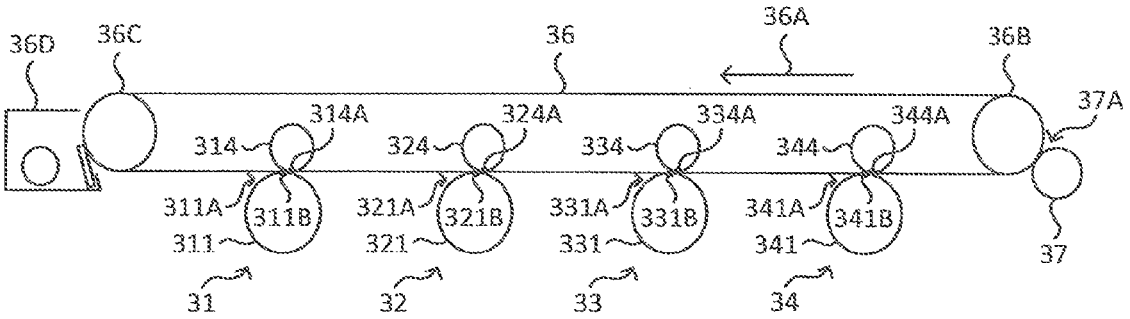
FIG. 4 is a diagram showing the configuration of a peripheral of an intermediate transfer belt included in the image forming apparatus according to an embodiment of the present disclosure.

First, an outlined configuration of an image forming apparatus 10 according to an embodiment of the present disclosure is described with reference to FIGS. 1 through 4. Here, FIG. 1 is a schematic cross-sectional view showing the configuration of the image forming apparatus 10. FIG. 3 is a schematic cross-sectional view showing the configuration of an image forming unit 31. FIG. 4 is a schematic cross-sectional view showing the configuration of a peripheral of an intermediate transfer belt 36.

Figure 2:
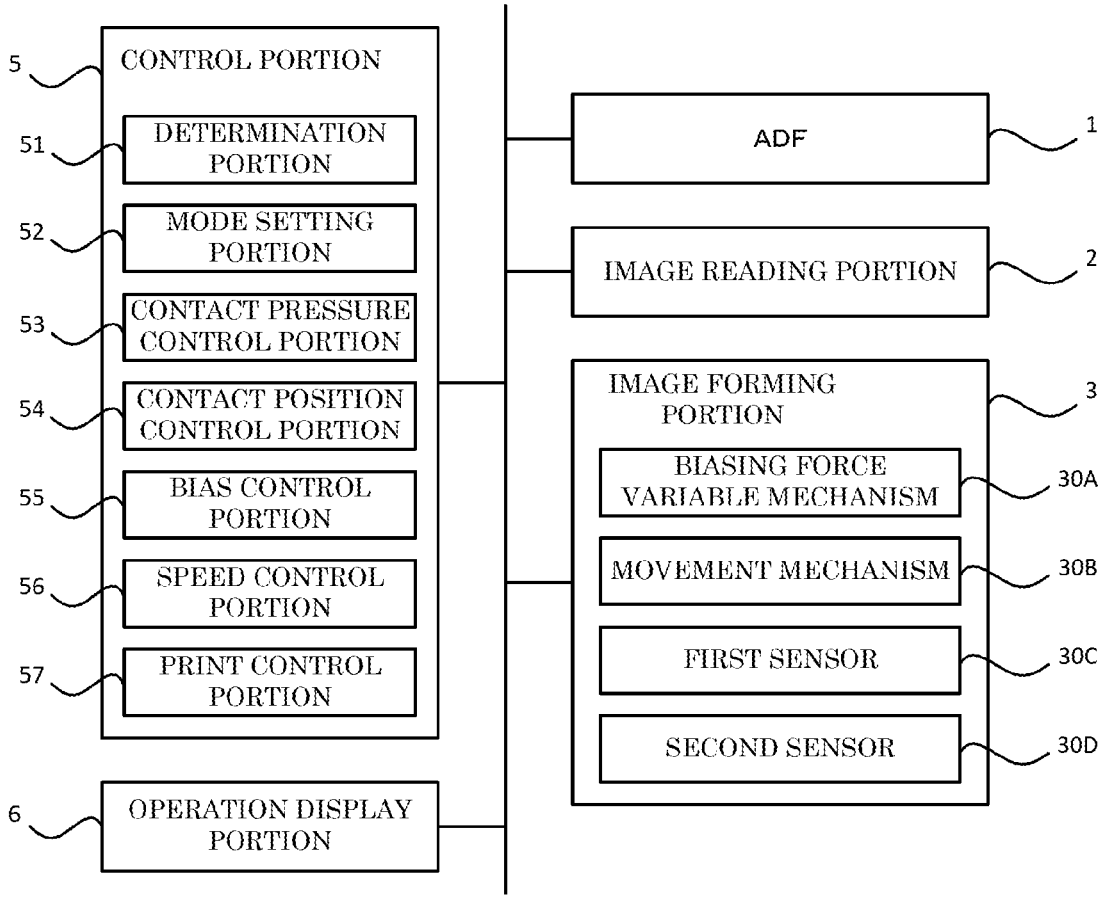
FIG. 2 is a block diagram showing the system configuration of the image forming apparatus according to an embodiment of the present disclosure.

As shown in FIGS. 1 and 2, an image forming apparatus 10 includes an ADF 1, an image reading portion 2, an image forming portion 3, a sheet feed portion 4, a control portion 5, and an operation display portion 6. The image forming apparatus 10 is a multifunction peripheral having a plurality of functions such as a scan function, a facsimile function, and a copy function, as well as a printer function to form an image based on image data. In addition, the present disclosure is applicable to an image forming apparatus such as a printer apparatus, a facsimile apparatus, and a copier.

The ADF 1 is an automatic document feeding device which includes a document sheet setting portion, a plurality of conveying rollers, a document sheet pressing, and a sheet discharge portion that are not shown, and conveys a document sheet in such a way as to be read by the image reading portion 2. The image reading portion 2 includes a document sheet table, a reading unit, a plurality of mirrors, an optical lens, and a CCD (Charge Coupled Device) that are not shown, and reads image data from a document sheet. The operation display portion 6 includes a display portion and an operation portion. The display portion is, for example, a liquid crystal display that displays various types of information in response to control instructions from the control portion 5. The operation portion includes operation keys or a touch panel for inputting various types of information to the control portion 5.

The control portion 5 includes control equipment (not shown) such as CPU, ROM, RAM, and EEPROM. The CPU is a processor for executing various types of arithmetic processes. The ROM is a nonvolatile storage portion in which various types of information such as control programs for causing the CPU to execute various types of processes are stored in advance. The RAM is a volatile storage portion, and the EEPROM is a nonvolatile storage portion. The RAM and the EEPROM are used as temporary storage memories (working areas) for the various types of processes executed by the CPU. The control portion 5 comprehensively controls the image forming apparatus 10 by executing the various types of control programs stored in advance in the ROM, by using the CPU.

The image forming portion 3 is configured to execute an image forming process (print process) for forming a color or monochrome image by the electrophotography based on image data which has been read by the image reading portion 2. In addition, the image forming portion 3 can execute the print process based on image data input from an external information processing apparatus such as a personal computer.

Specifically, as shown in FIG. 1, the image forming portion 3 includes a plurality of image forming units 31-34, an optical scanning device (LSU) 35, an intermediate transfer belt 36, a secondary transfer roller 37, a fixing device 38, and a sheet discharge tray 39. The image forming units 31-34 are electrophotographic image forming units that correspond to C (cyan), M (magenta), Y (yellow), and K (black), respectively. The image forming units 31-34 are disposed in alignment along a conveyance direction 36A of the intermediate transfer belt 36 in order of cyan, magenta, yellow, and black from the upstream side of the conveyance direction 36A.

As shown in FIG. 3, the image forming unit 31 includes a photoconductor drum 311, a charging device 312, a developing device 313, a primary transfer roller 314, and a drum cleaning portion 315. It is noted that each of the image forming units 32-34 has a similar configuration to the image forming unit 31. Here, photoconductor drums 311, 321, 331 and 341 respectively included in the image forming units 31, 32, 33 and 34 are an example of the plurality of image carriers of the present disclosure. In addition, primary transfer rollers 314, 324, 334 and 344 respectively included in the image forming units 31, 32, 33 and 34 are an example of the plurality of transfer rollers of the present disclosure. In the image forming portion 3, a color image is formed in the following procedure on a sheet supplied from the sheet feed portion 4. The sheet with the image formed thereon is discharged onto the sheet discharge tray 39. It is noted that the sheet is a sheet-like material such as a sheet of paper, a sheet of coated paper, a postcard, an envelope, or an OHP sheet.

First, in the image forming unit 31, the charging device 312 charges the surface of the photoconductor drum 311 uniformly to a certain potential. Next, the optical scanning device 35 irradiates the surface of the photoconductor drum 311 with light based on the image data. With this operation, an electrostatic latent image that corresponds to the image data is formed on the surface of the photoconductor drum 311. The electrostatic latent image on the photoconductor drum 311 is developed (visualized) as a cyan toner image by the developing device 313. Specifically, toner is supplied from a developing roller 313A of the developing device 313 to the photoconductor drum 311 such that the electrostatic latent image on the photoconductor drum 311 is developed as a toner image. It is noted that inside the developing device 313, developer including toner and carrier is stirred by a stirring screw 313B in such a way as to be charged by the friction, and conveyed to a magnetic roller 313C, and the toner included in the developer is transported from the magnetic roller 313C to the developing roller 313A. In addition, cyan toner is supplied from a toner container 313D (see FIG. 1) to the developing device 313, wherein the toner container 313D is attachable to and detachable from the image forming portion 3.

Subsequently, the toner image of cyan formed on the photoconductor drum 311 is transferred to the intermediate transfer belt 36 by the primary transfer roller 314. Specifically, the toner image on the photoconductor drum 311 is transferred to the intermediate transfer belt 36 at a primary transfer nip portion 311A by a transfer bias voltage that is applied to the primary transfer roller 314, wherein the primary transfer nip portion 311A is formed by the photoconductor drum 311, the intermediate transfer belt 36 and the primary transfer roller 314. On the other hand, toner that has remained on the surface of the photoconductor drum 311 is removed by the drum cleaning portion 315. For example, in the drum cleaning portion 315, toner that has remained on the surface of the photoconductor drum 311 is removed by a blade-like cleaning member 315A. The toner that has been removed by the cleaning member 315A is conveyed by a conveyance screw 315B to a toner collection container (not shown) and collected therein.

Here, as shown in FIG. 4, the intermediate transfer belt 36 is a belt member that is formed in an endless shape and wound around a driving roller 36B and a driven roller 36C, and is provided in such a way as to be in contact with the photoconductor drums 311-341 of the image forming units 31-34. In addition, the primary transfer rollers 314-344 of the image forming units 31-34 are provided in such a way as to be in contact with the intermediate transfer belt 36, and primary transfer nip portions 311A, 321A, 331A, and 341A are formed on the intermediate transfer belt 36. The driving roller 36B is rotationally driven by a motor (not shown) such that the intermediate transfer belt 36 can convey the toner images transferred from the photoconductor drums 311-341 along the conveyance direction 36A.

In the image forming units 32-34, too, toner images of respective colors are formed on the photoconductor drums 321-341 provided in the image forming units 32-34, by the same processing procedure as in the image forming unit 31. Subsequently, the toner images are transferred from the photoconductor drums 311-341 to the intermediate transfer belt 36 in such a way as to be overlaid on the intermediate transfer belt 36 in order of cyan, magenta, yellow, and black. The toner image is then transferred, by the secondary transfer roller 37, from the intermediate transfer belt 36 to a sheet supplied from the sheet feed portion 4, at a secondary transfer nip portion 37A formed by the driving roller 36B and the secondary transfer roller 37.

Subsequently, the sheet on which the toner image has been transferred is sent to the fixing device 38 in which the toner image is fused and fixed, thereby an image is formed on the sheet. The sheet is then discharged onto the sheet discharge tray 39. On the other hand, toner that has remained on the surface of the intermediate transfer belt 36 is removed by a belt cleaning portion 36D. The belt cleaning portion 36D includes, for example, a blade-like cleaning member and a conveyance screw, as is the case with the drum cleaning portion 315, and cleans the surface of the intermediate transfer belt 36.

Meanwhile, in an image forming apparatus such as the image forming apparatus 10, when a character image is printed, a phenomenon called void of image may occur, in which a part of the toner images formed on the photoconductor drums 311-341 is not transferred to the intermediate transfer belt 36, and a hole is made in the toner image on the intermediate transfer belt 36. It is known that the void of image occurs when the toner aggregates in the primary transfer nip portions 311A-341A due to stress concentration. As a technology related to this problem, there is known an image forming apparatus that can restrict the occurrence of the void of image by reducing the contact pressures applied to the intermediate transfer belt 36 respectively from all the primary transfer rollers 314-344 or by reducing the contact pressure applied only from the primary transfer roller 344 for transferring a black toner image.

However, in the case where the contact pressures applied from all the primary transfer rollers 314-344 are reduced as mentioned above, the running of the intermediate transfer belt 36 becomes unstable, and a color shift may occur in the toner image formed on the intermediate transfer belt 36. In addition, the void of image is likely to occur when a toner image is overlaid with another toner image transferred on the intermediate transfer belt 36. As a result, when the contact pressure applied only from the primary transfer roller 344 for transferring a black toner image is reduced as in the case of the related technology, the void of image that would occur when a toner image of another color is overlaid, is not restricted. On the other hand, as described in the following, the image forming apparatus 10 is configured to ensure the running stability of the intermediate transfer belt 36 and restrict the void of image from occurring in the toner image transferred on the intermediate transfer belt 36.

Specifically, in the image forming apparatus 10, the print process is executed in a first print mode or a second print mode, wherein for the first print mode, print conditions are set in advance in correspondence with printing of a character image, and for the second print mode, print conditions are set in advance in correspondence with printing of a non-character image. When the print process is executed in the first print mode, contact pressures applied to the intermediate transfer belt 36 from primary transfer rollers that are, among the primary transfer rollers 314-334, disposed on the downstream side in the conveyance direction 36A, are reduced to be lower than the contact pressures in the second print mode.

More specifically, in the image forming apparatus 10, when the print process is executed in the first print mode, contact pressures of the primary transfer rollers 324-334 disposed on the downstream side in the conveyance direction 36A are reduced. On the other hand, the contact pressure of the primary transfer roller 314 disposed on the most upstream side is not reduced, nor is the contact pressure of the primary transfer roller 344 for transferring a black toner image. Here, the primary transfer roller 344 for transferring a black toner image to the intermediate transfer belt 36 is an example of the first transfer roller of the present disclosure. In addition, the primary transfer rollers 314-334 for transferring cyan, magenta and yellow toner images to the intermediate transfer belt 36 are an example of the plurality of second transfer rollers of the present disclosure.

In the image forming apparatus 10, for example, each of the primary transfer rollers 314-344 is biased toward the intermediate transfer belt 36 by a biasing member such as a coil spring such that the primary transfer roller is in contact with the intermediate transfer belt 36. In addition, the image forming apparatus 10 is provided with biasing force variable mechanisms 30A that can reduce the respective biasing forces applied from the biasing members to the primary transfer rollers 324-334 (see FIG. 2). The control portion 5 is configured to reduce the contact pressures of the primary transfer rollers 324-334 by controlling the biasing force variable mechanisms 30A based on the print mode.

In addition, in the image forming apparatus 10, as shown in FIG. 3, the primary transfer roller 314 contacts with the intermediate transfer belt 36 at a predetermined position 314A, wherein the position 314A is on the downstream side of a contact position 311B in the conveyance direction 36A, the contact position 311B being a position at which the photoconductor drum 311 contacts with the intermediate transfer belt 36. Similarly, the primary transfer rollers 324-344 contact with the intermediate transfer belt 36 at predetermined positions 324A-344A that are, in the conveyance direction 36A, on the downstream side of contact positions 321B-341B where the photoconductor drums 321-341 contact with the intermediate transfer belt 36, respectively (see FIG. 4). Furthermore, when the print process is executed in the first print mode, the primary transfer rollers 324-334, whose contact pressures are reduced, are moved toward the upstream side in the conveyance direction 36A. For example, the primary transfer roller 324 is moved to the contact position 321B, and the primary transfer roller 334 is moved to the contact position 331B.

Specifically, the image forming apparatus 10 is provided with a movement mechanism 30B (see FIG. 2) that moves the primary transfer rollers 324-334 toward the upstream side in the conveyance direction 36A. The control portion 5 is configured to move the primary transfer rollers 324-334 based on the print mode by controlling the movement mechanism 30B.

On the other hand, the ROM of the control portion 5 stores, in advance, a print control program for causing the CPU of the control portion 5 to execute a print control process (see the flowchart of FIG. 5) as described below. It is noted that the print control program may be recorded on a computer-readable recording medium such as a CD, a DVD, or a flash memory and installed onto a storage portion such as the EEPROM from the recording medium.

The control portion 5 includes a determination portion 51, a mode setting portion 52, a contact pressure control portion 53, a contact position control portion 54, a bias control portion 55, a speed control portion 56, and a print control portion 57. Specifically, the control portion 5 functions as the determination portion 51, mode setting portion 52, contact pressure control portion 53, contact position control portion 54, bias control portion 55, speed control portion 56, and print control portion 57 when it executes, by using the CPU, the control programs stored in the ROM.

The determination portion 51 determines whether or not the image data printed in the print process is character image data.

The mode setting portion 52 sets the print mode of the print process to the first print mode or the second print mode based on the determination result of the determination portion 51.

For example, when the determination portion 51 determines that the image data printed in the print process is character image data, the mode setting portion 52 sets the print mode to the first print mode by writing a value "1" into a flag that is set to indicate the print mode in a predetermined storage area of the RAM.

On the other hand, when the determination portion 51 determines that the image data printed in the print process is not character image data, the mode setting portion 52 sets the print mode to the second print mode by writing a value "0" into the flag indicating the print mode in the RAM.

It is noted that the mode setting portion 52 may set the print mode to the first print mode or the second print mode based on a user operation input to the operation display portion 6.

When the print process is executed in the first print mode, the contact pressure control portion 53 reduces the contact pressures of the primary transfer rollers 324-334, which are disposed on the downstream side in the conveyance direction 36A of the intermediate transfer belt 36 among the primary transfer rollers 314-334, such that the contact pressures become lower than the contact pressures in the second print mode. Specifically, the contact pressure control portion 53 reduces the contact pressures of the primary transfer rollers 324-334 by controlling the biasing force variable mechanisms 30A provided on the primary transfer rollers 324-334.

When the print process is executed in the first print mode, the contact position control portion 54 moves the primary transfer rollers 324-334, whose contact pressures are reduced by the contact pressure control portion 53, toward the upstream side in the conveyance direction 36A. Specifically, the contact position control portion 54 moves the primary transfer rollers 324-334 from the positions 324A-334A to the contact positions 321B-331B respectively by controlling the movement mechanism 30B.

When the print process is executed in the first print mode, the bias control portion 55 increases transfer bias voltages that are applied to the primary transfer rollers 324-334 whose contact pressures are reduced by the contact pressure control portion 53, such that the transfer bias voltages become higher than the transfer bias voltages in the second print mode.

Specifically, when the print process is executed in the second print mode, the bias control portion 55 reads initial set values of the transfer bias voltages to be applied to the primary transfer rollers 314-344, wherein the initial set values are stored in the ROM in advance. The bias control portion 55 then sets the transfer bias voltages to be applied to the primary transfer rollers 314-344, by storing the read initial set values of the transfer bias voltages into a predetermined storage area in the RAM.

On the other hand, when the print process is executed in the first print mode, the bias control portion 55 adds a predetermined additional voltage value to each of the initial set values of the transfer bias voltages to be applied to the primary transfer rollers 324-334 read from the ROM. The bias control portion 55 then sets the transfer bias voltages to be applied to the primary transfer rollers 324-334 to be higher than the transfer bias voltages in the second print mode, by storing the result values of adding the additional voltage value to the initial set values of the transfer bias voltages, into the storage area in the RAM.

When the print process is executed in the first print mode, the speed control portion 56 increases a speed difference between a conveyance speed of the intermediate transfer belt 36 and a movement speed of the toner image carrying surface of the photoconductor drums 311-341 such that the speed difference becomes larger than the speed difference in the second print mode.

Specifically, when the print process is executed in the second print mode, the speed control portion 56 reads an initial set value of the conveyance speed of the intermediate transfer belt 36, wherein the initial set value is stored in the ROM in advance. The speed control portion 56 then sets the conveyance speed by storing the read initial set value of the conveyance speed into a predetermined storage area in the RAM. It is noted that in the image forming apparatus 10, the initial set value of the conveyance speed is set to be the same as the rotation speed of the photoconductor drums 311-341.

On the other hand, when the print process is executed in the first print mode, the speed control portion 56 adds a predetermined additional speed value to the initial set value of the conveyance speed read from the ROM. The speed control portion 56 then sets the conveyance speed to be higher than the conveyance speed in the second print mode by storing the result value of adding the additional speed value to the initial set value of the conveyance speed, into the storage area in the RAM.

The print control portion 57 executes the print process in the first print mode or the second print mode. Specifically, the print control portion 57 executes the print process in the print mode set by the mode setting portion 52, under the print conditions that are set by the contact pressure control portion 53, contact position control portion 54, bias control portion 55, and speed control portion 56 for the print mode.

[Print Control Process]

Figure 5:
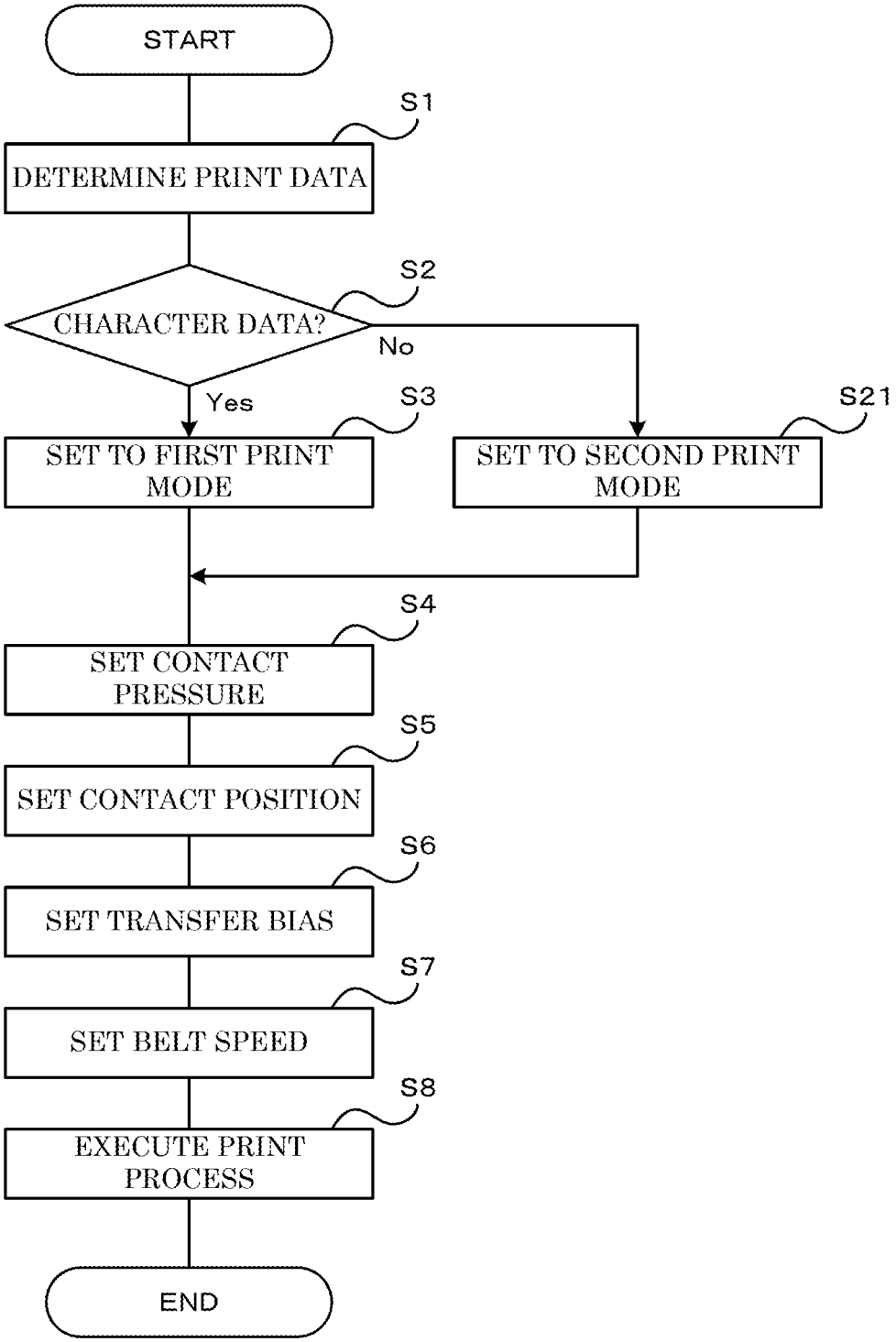
FIG. 5 is a flowchart showing an example of a print control process that is executed by the image forming apparatus according to an embodiment of the present disclosure.

The following describes, with reference to FIG. 5, an example of the procedure of the print control process that is executed by the control portion 5 based on the print control program in the image forming apparatus 10. Here, steps S1, S2, . . . represent numbers of the processing procedures (steps) executed by the control portion 5. It is noted that the control portion 5 executes the print control process when image data is received from an external information processing apparatus, or when a user operation is input to the operation display portion 6, the user operation instructing to execute the print process on image data read by the image reading portion 2.

<Step S1>

First, at step S1, the control portion 5 performs determination of whether or not image data received from the external information processing apparatus or image data read by the image reading portion 2 is character image data. Here, the process of the step S1 is executed by the determination portion 51 of the control portion 5.

For example, the control portion 5 may binarize the determination target data, and detect the number of lines with a predetermined width that exist in the binarized determination target data. The control portion 5 then may determine that the determination target data is not character image data when the detected number of lines is equal to or smaller than a predetermined reference value, and may determine that the determination target data is character image data when the detected number of lines is larger than the predetermined reference value. As another example, the control portion 5 may determine that the determination target data is character image data when the ratio of the number of black pixels to the total number of pixels in the binarized determination target data is equal to or lower than a predetermined reference value, and may determine that the determination target data is not character image data when the ratio is higher than the predetermined reference value.

<Step S2>

At step S2, the control portion 5 determines whether or not the determination result of the step S1 is character image data.

Here, upon determining that the determination result of the step S1 is character image data (Yes side at S2), the control portion 5 moves the process to step S3. In addition, upon determining that the determination result of the step S1 is not character image data (No side at S2), the control portion 5 moves the process to step S21.

<Step S21>

At step S21, the control portion 5 sets the print mode to the second print mode by writing a value "0" into the flag in the RAM indicating the print mode.

<Step S3>

At step S3, the control portion 5 sets the print mode to the first print mode by writing a value "1" into the flag in the RAM indicating the print mode. Here, the processes of the steps S2, S21 and S3 are executed by the mode setting portion 52 of the control portion 5.

<Step S4>

At step S4, the control portion 5 sets the contact pressures of the primary transfer rollers 324-334, based on the print mode set at the step S21 or S3. Here, the process of the step S4 is an example of the second step of the present disclosure, and is executed by the contact pressure control portion 53 of the control portion 5.

Specifically, the control portion 5 determines whether or not the contact pressures of the primary transfer rollers 324-334 are in a reduced state, by using a first sensor 30C (see FIG. 2) that detects the state of the biasing force variable mechanisms 30A. When it determines that the contact pressures of the primary transfer rollers 324-334 are not in the reduced state, and the print mode is set to the first print mode at the step S3, the control portion 5 reduces the contact pressures of the primary transfer rollers 324-334 by controlling the biasing force variable mechanisms 30A. In addition, when it determines that the contact pressures of the primary transfer rollers 324-334 are in the reduced state, and the print mode is set to the second print mode at the step S21, the control portion 5 increases the contact pressures of the primary transfer rollers 324-334 by controlling the biasing force variable mechanisms 30A.

With this configuration, in the first print mode, the contact pressure of the primary transfer roller 314 is maintained and the running stability of the intermediate transfer belt 36 is ensured, wherein the primary transfer roller 314 is disposed at the primary transfer nip portion 311A on the most upstream side in the conveyance direction 36A where the void of image is difficult to occur. In addition, in the second print mode, the contact pressures of the primary transfer rollers 324-334 are reduced, thereby the void of image is restricted from occurring, because the primary transfer rollers 324-334 are respectively disposed at the primary transfer nip portion 321A-331A on the downstream side in the conveyance direction 36A where the void of image is likely to occur. It is noted that, among the primary transfer rollers 324-334, the contact pressure of the primary transfer roller 334 that is disposed on the downstream side of the primary transfer roller 324 in the conveyance direction 36A may be reduced to be lower than the contact pressure of the primary transfer roller 324.

Furthermore, in the image forming apparatus 10, in the first print mode, the contact pressure of the primary transfer roller 344 for transferring a black toner image is maintained, because the black toner image is rarely overlaid with toner images of other colors. This allows the running stability of the intermediate transfer belt 36 to be improved. It is noted that, as another embodiment, the contact pressure of the primary transfer roller 344 for transferring a black toner image may be reduced.

<Step S5>

At step S5, the control portion 5 sets the contact positions where the primary transfer rollers 324-334 contact with the intermediate transfer belt 36, based on the print mode set at the step S21 or S3. Here, the process of the step S5 is executed by the contact position control portion 54 of the control portion 5.

The control portion 5 determines whether or not the primary transfer rollers 324-334 have moved to the contact positions 321B-331B, by using a second sensor 30D (see FIG. 2) that detects the state of the movement mechanism 30B. When it determines that the primary transfer rollers 324-334 have not moved to the contact positions 321B-331B, and the print mode is set to the first print mode at the step S3, the control portion 5 moves the primary transfer rollers 324-334 to the contact positions 321B-331B by controlling the movement mechanism 30B. In addition, when it determines that the primary transfer rollers 324-334 have moved to the contact positions 321B-331B, and the print mode is set to the second print mode at the step S3, the control portion 5 moves the primary transfer rollers 324-334 to the positions 324A-334A by controlling the movement mechanism 30B.

With the above-described operation, in the second print mode, the primary transfer rollers 314-344 are respectively disposed on the downstream side of the contact positions 311B-341B in the conveyance direction 36A, and the transfer property at the primary transfer nip portions 311A-341A is improved. In addition, in the first print mode, the primary transfer rollers 324-334 that are disposed at the primary transfer nip portion 321A-331A where the void of image is likely to occur are moved toward the upstream side in the conveyance direction 36A so that the timing of transfer by the application of the transfer bias voltage comes earlier, and the effect of restricing the void of image is improved. It is noted that, as another embodiment, in the first print mode, the primary transfer rollers 324-334 may not be moved toward the upstream side in the conveyance direction 36A.

<Step S6>

At step S6, the control portion 5 sets the transfer bias voltages that are to be applied to the primary transfer rollers 314-344, based on the print mode set at the step S21 or S3. Here, the process of the step S6 is executed by the bias control portion 55 of the control portion 5.

Specifically, when the print mode is set to the second print mode at the step S21, the control portion 5 reads the initial set values of the transfer bias voltages from the ROM, and sets the transfer bias voltages to be applied to the primary transfer rollers 314-344 by storing the read initial set values of the transfer bias voltages into the predetermined storage area in the RAM.

On the other hand, when the print mode is set to the first print mode at the step S3, the control portion 5 adds the additional voltage value to the initial set values of the transfer bias voltages to be applied to the primary transfer rollers 324-334 read from the ROM. The control portion 5 then sets the transfer bias voltages that are to be applied to the primary transfer rollers 324-334 to be higher than the transfer bias voltages in the second print mode, by storing the result values of adding the additional voltage value to the initial set values of the transfer bias voltages, into the storage area in the RAM.

With the above-described operation, in the first print mode, the transfer bias voltages that are applied to the primary transfer rollers 324-334 disposed at the primary transfer nip portion 321A-331A where the void of image is likely to occur, are increased to be higher than the transfer bias voltages in the second print mode. As a result, the effect of restricing the void of image is improved.

It is noted that when the transfer bias voltages that are applied to the primary transfer rollers 324-334 are increased while the transfer bias voltage that is applied to the primary transfer roller 344 positioned on the downstream side of the primary transfer rollers 324-334 in the conveyance direction 36A is not increased, the transfer property may be degraded at the primary transfer nip portion 341A. As a result, it is desired that, in the first print mode, the transfer bias voltage that is applied to the primary transfer roller 344 is also increased, as well as the transfer bias voltages applied to the primary transfer rollers 324-334.

<Step S7>

At step S7, the control portion 5 sets the conveyance speed of the intermediate transfer belt based on the print mode set at the step S21 or S3. Here, the process of the step S7 is executed by the speed control portion 56 of the control portion 5.

Specifically, when the print mode is set to the second print mode at the step S21, the control portion 5 reads the initial set value of the conveyance speed from the ROM. The control portion 5 then sets the conveyance speed by storing the read initial set value of the conveyance speed into the storage area in the RAM.

On the other hand, when the print mode is set to the first print mode at the step S3, the control portion 5 adds the additional speed value to the initial set value of the conveyance speed read from the ROM. The control portion 5 then sets the conveyance speed to be higher than the conveyance speed in the second print mode by storing the result value of adding the additional speed value to the initial set value of the conveyance speed, into the storage area in the RAM.

With the above-described operation, in the first print mode, a shearing force against the toner that has adhered to the photoconductor drums 311-341 occurs at the primary transfer nip portions 311A-341A due to a speed difference between the conveyance speed of the intermediate transfer belt 36 and the rotation speed of the photoconductor drums 311-341. As a result, the void of image is restricted from occurring at the primary transfer nip portions 311A-341A.

<Step S8>

At step S8, the control portion 5 executes the print process under the print conditions that have been set at the steps S4-S7. Here, the process of the step S8 is an example of the first step of the present disclosure, and is executed by the print control portion 57 of the control portion 5.

Specifically, the control portion 5 applies the transfer bias voltages to the primary transfer rollers 314-344 during the print process by controlling a power source (not shown) that applies the transfer bias voltages to the primary transfer rollers 314-344, based on the transfer bias voltages set at the step S6.

In addition, the control portion 5 runs the intermediate transfer belt 36 during the print process by controlling the motor that rotationally drives the driving roller 36B, based on the conveyance speed set at the step S7.

As described above, in the print control process, the contact pressures applied to the intermediate transfer belt 36 from the primary transfer rollers 324-334 are varied based on the print mode. With this configuration, the running stability of the intermediate transfer belt 36 is ensured, and the void of image is restricted from occurring in the toner image transferred to the intermediate transfer belt 36.

It is noted that in the print control process, any one or more processes of the steps S5-S7 may be omitted. In addition, in the image forming apparatus 10, the omission of any one or more processes of the steps S5-S7 from the print control process may be set in response to a setting operation performed by the user on the operation display portion 6.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of image carriers configured to carry toner images of different colors;

an intermediate transfer belt provided in such a way as to be in contact with the image carriers and on which the toner images carried by the image carriers are transferred and overlaid;

a plurality of transfer rollers provided in such a way as to be in contact with the intermediate transfer belt at positions respectively corresponding to the image carriers, and configured to transfer the toner images carried by the image carriers to the intermediate transfer belt, the plurality of transfer rollers including a first transfer roller and a plurality of second transfer rollers, wherein the first transfer roller transfers a toner image of a predetermined color to the intermediate transfer belt, and the plurality of second transfer rollers transfer toner images of colors that are different from the predetermined color to the intermediate transfer belt;

a print control portion configured to execute a print process in a first print mode or a second print mode that are set in advance;

a contact pressure control portion configured to, when the print process is executed in the first print mode, reduce a contact pressure of one or more transfer rollers that are, among the plurality of second transfer rollers, disposed on a downstream side in a conveyance direction of the intermediate transfer belt, to be lower than a contact pressure thereof in the second print mode, while maintaining a contact pressure applied to the intermediate transfer belt by a second transfer roller that is disposed on the most upstream side in the conveyance direction among the plurality of second transfer rollers; and a contact position control portion configured to, when the print process is executed in the first print mode, move the one or more second transfer rollers toward an upstream side in the conveyance direction, wherein the contact pressure of the one or more second transfer rollers applied to the intermediate transfer belt is reduced by the contact pressure control portion, wherein the plurality of transfer rollers contact with the intermediate transfer belt at predetermined positions that are, in the conveyance direction, on the downstream side of contact positions at which the image carriers contact with the intermediate transfer belt, the contact pressure control portion determines whether or not the contact pressure of the one or more second transfer rollers disposed on the downstream side is in a reduced state, by using a first sensor that detects a state of biasing force variable mechanisms that are configured to reduce the contact pressure of the one or more second transfer rollers applied to the intermediate transfer belt, and when the print mode is set to the first print mode, upon determining that the contact pressure is not in the reduced state, the contact pressure control portion reduces the contact pressure, and when the print mode is set to the second print mode, upon determining that the contact pressure is in the reduced state, the contact pressure control portion increases the contact pressure, and the contact position control portion determines whether or not the one or more second transfer rollers disposed on the downstream side have been moved toward the upstream side in the conveyance direction by the contact position control portion, by using a second sensor that detects a state of a movement mechanism that is configured to move the one or more second transfer rollers disposed on the downstream side toward the upstream side in the conveyance direction, and when the print mode is set to the first print mode, upon determining that the one or more second transfer rollers disposed on the downstream side have not been moved toward the upstream side, the contact position control portion moves the one or more second transfer rollers toward the upstream side, and when the print mode is set to the second print mode, upon determining that the one or more second transfer rollers have been moved toward the upstream side, the contact position control portion moves the one or more second transfer rollers toward the downstream side.

2. The image forming apparatus according to claim 1, wherein the first print mode is a print mode for which print conditions are set in advance in correspondence with printing of a character image, and the second print mode is a print mode for which print conditions are set in advance in correspondence with printing of a non-character image.

3. The image forming apparatus according to claim 1, wherein the predetermined color is black.

4. The image forming apparatus according to claim 1 further comprising:

a bias control portion configured to, when the print process is executed in the first print mode, increase a transfer bias voltage that is applied to the one or more transfer rollers, to be higher than a transfer bias voltage applied thereto in the second print mode, wherein the contact pressure of the one or more transfer rollers applied to the intermediate transfer belt is reduced by the contact pressure control portion.

5. The image forming apparatus according to claim 1 further comprising:

a speed control portion configured to, when the print process is executed in the first print mode, increase a speed difference between a conveyance speed of the intermediate transfer belt and a movement speed of image carrying surfaces of the image carriers, to be larger than a speed difference in the second print mode.

6. The image forming apparatus according to claim 1 further comprising:

a determination portion configured to determine whether or not image data printed in the print process is character image data; and a mode setting portion configured to set the print mode of the print process to the first print mode or the second print mode based on a determination result of the determination portion.

7. An image forming method executed in an image forming apparatus including a plurality of image carriers configured to carry toner images of different colors, an intermediate transfer belt provided in such a way as to be in contact with the image carriers and on which the toner images carried by the image carriers are transferred and overlaid, and a plurality of transfer rollers provided in such a way as to be in contact with the intermediate transfer belt at positions respectively corresponding to the image carriers, the plurality of transfer rollers including a first transfer roller and a plurality of second transfer rollers, wherein the first transfer roller transfers a toner image of a predetermined color to the intermediate transfer belt, and the plurality of second transfer rollers transfer toner images of colors that are different from the predetermined color to the intermediate transfer belt, the image forming method comprising:

a first step of executing a print process in a first print mode or a second print mode that are set in advance; and a second step of, when the print process is executed in the first print mode, reducing a contact pressure of one or more transfer rollers that are, among the plurality of second transfer rollers, disposed on a downstream side in a conveyance direction of the intermediate transfer belt, to be lower than a contact pressure thereof in the second print mode, while maintaining a contact pressure applied to the intermediate transfer belt by a second transfer roller that is disposed on the most upstream side in the conveyance direction among the plurality of second transfer rollers;

a third step of, when the print process is executed in the first print mode, moving the one or more second transfer rollers toward an upstream side in the conveyance direction, wherein the contact pressure of the one or more second transfer rollers applied to the intermediate transfer belt is reduced, wherein the plurality of transfer rollers contact with the intermediate transfer belt at predetermined positions that are, in the conveyance direction, on the downstream side of contact positions at which the image carriers contact with the intermediate transfer belt;

a fourth step of determining whether or not the contact pressure of the one or more second transfer rollers disposed on the downstream side is in a reduced state, by using a first sensor that detects a state of biasing force variable mechanisms that are configured to reduce the contact pressure of the one or more second transfer rollers applied to the intermediate transfer belt, and when the print mode is set to the first print mode, upon determining that the contact pressure is not in the reduced state, the method further comprises reducing the contact pressure, and when the print mode is set to the second print mode, upon determining that the contact pressure is in the reduced state, the method further comprises increasing the contact pressure; and a fifth step of determining whether or not the one or more second transfer rollers disposed on the downstream side have been moved toward the upstream side in the conveyance direction by the contact position control portion, by using a second sensor that detects a state of a movement mechanism that is configured to move the one or more second transfer rollers disposed on the downstream side toward the upstream side in the conveyance direction, and when the print mode is set to the first print mode, upon determining that the one or more second transfer rollers disposed on the downstream side have not been moved toward the upstream side, the method further comprises moving the one or more second transfer rollers toward the upstream side, and when the print mode is set to the second print mode, upon determining that the one or more second transfer rollers have been moved toward the upstream side, the method further comprises moving the one or more second transfer rollers toward the downstream side.

* * * * *